US006919677B2

(12) United States Patent
Murakami

(10) Patent No.: US 6,919,677 B2
(45) Date of Patent: Jul. 19, 2005

(54) GLASS FUNNEL FOR A CATHODE RAY TUBE AND CATHODE RAY TUBE

(75) Inventor: Toshihide Murakami, Chiba (JP)

(73) Assignee: Asahi Glass Company, Limited, Tokyo (JP)

( * ) Notice: Subject to any disclaimer, the term of this patent is extended or adjusted under 35 U.S.C. 154(b) by 0 days.

(21) Appl. No.: 10/824,514

(22) Filed: Apr. 15, 2004

(65) Prior Publication Data

US 2004/0227450 A1 Nov. 18, 2004

Related U.S. Application Data

(63) Continuation of application No. PCT/JP02/10802, filed on Oct. 17, 2002.

(30) Foreign Application Priority Data

Oct. 17, 2001 (JP) ..... 2001-319107

(51) Int. Cl.[7] ..... H01J 29/86
(52) U.S. Cl. ..... 313/477 R; 220/2.1 A
(58) Field of Search ..... 313/477 R, 482, 313/364; 220/2.1 A, 2.3 A

(56) References Cited

U.S. PATENT DOCUMENTS 2,232,098 A * 2/1941 Deichman ..... 220/2.3 A
2,551,790 A * 5/1951 Davis et al. ..... 348/825
2,570,165 A * 10/1951 Shekels ..... 313/250
2,603,177 A * 7/1952 Gardiner ..... 72/375
2,969,162 A * 1/1961 Stutske ..... 220/2.1 A
3,166,211 A * 1/1965 Stel et al. ..... 220/2.1 A
3,934,169 A * 1/1976 Groothoff et al. ..... 313/477 R
4,130,837 A * 12/1978 Andre et al. ..... 348/830
4,528,477 A * 7/1985 Gallaro ..... 313/479
5,155,411 A * 10/1992 Swank et al. ..... 313/477 R
6,392,336 B1 5/2002 Sugawara et al.
6,577,055 B1 6/2003 Sugawara et al.
6,580,209 B2 6/2003 Murakami

FOREIGN PATENT DOCUMENTS

| | | |
|---|---|---|
| EP | 1 162 644 A2 | 12/2001 |
| JP | 57-518 | 1/1982 |
| JP | 8-77949 | 3/1996 |
| JP | 10-144238 | 5/1998 |
| JP | 2000-243316 | 9/2000 |
| JP | 2000-251765 | 9/2000 |
| JP | 2001-332190 | 11/2001 |

* cited by examiner

*Primary Examiner*—Vip Patel
*Assistant Examiner*—Glenn Zimmerman
(74) *Attorney, Agent, or Firm*—Oblon, Spivak, McClelland, Maier & Neustadt, P.C.

(57) ABSTRACT

The present invention has an object to provide a glass funnel, which is safe, highly reliable and lightweight. The object is solved by a glass funnel wherein an outwardly projecting bent portion is provided along at least a part of an outer peripheral area, where the body portion intersects with a plane perpendicular to a bulb axis, and which includes intersecting points between the outer peripheral area and a plane containing a diagonal axis and the bulb axis, and the bent portion is provided at a specific position.

24 Claims, 5 Drawing Sheets

GLASS FUNNEL FOR A CATHODE RAY TUBE AND CATHODE RAY TUBE

This is a continuation of application Ser. No. PCT/JP02/10802, filed Oct. 17, 2002.

TECHNICAL FIELD

The present invention relates to a glass funnel for a cathode ray tube, which is mainly used in a TV broadcast receiver or an image display device for industrial use.

BACKGROUND ART

As shown in FIG. 9, a cathode ray tube 20 is basically composed of a glass panel for displaying an image 1, and a glass bulb including a glass funnel 2 having a neck portion 5 for housing an electron gun 6.

Referring to FIG. 9, the glass funnel 2 includes a body portion 3 having an open end for connection with the glass panel 1, the neck portion 5 for housing the electron gun 6, and an yoke portion connecting between the body portion and the neck portion and having an outer side configured so as to mount a deflection coil (deflection yoke) as a deflection unit for deflecting electron beams irradiated from the electron gun thereon. In FIG. 9, reference numeral 10 designates a sealing portion for sealing the glass panel 1 to the glass funnel 2 with solder glass or the like, reference numeral 11 designates an electron beam, reference numeral 12 designates a fluorescent film for emitting fluorescence by irradiation of electron beams 11, reference numeral 13 designates an aluminum film for reflecting forwardly light emitted from the fluorescent film, reference numeral 14 designates a shadow mask for determining the position of irradiated electron beams on the fluorescent film, reference numeral 15 designates a stud pin for fixing the shadow mask 14 to an inner surface of the glass panel 1, reference numeral 16 designates a reinforcing band for maintaining strength against impact, and reference numeral 17 designates an anode button, which is connected to outside for grounding so as to prevent the shadow mask 14 from being charged at a high potential by irradiation of electron beams 11.

Reference A designates a bulb axis, which connects between the central axis of the neck portion 5 and the center of the panel portion 3, and reference B designates an imaginary reference line, which indicates the center of deflection. The screen that is made of the fluorescent film 12 on the inner surface of the glass panel has a substantially rectangular shape having the bulb axis at the central point and is defined by 4 sides substantially parallel to a long axis or a short axis which cross perpendicular to the bulb axis.

The inside of the cathode ray tube is maintained under high vacuum to display an image by irradiation of electron beams in the glass bulb. The cathode ray tube not only has high deformation energy (strain energy) inherent therein since the cathode ray tube has an asymmetric structure, unlike a spherical shape, wherein a differential pressure of 1 atmospheric pressure is applied between the inside and the outside thereof. Additionally, the cathode ray tube is deformed in an unstable fashion. When the glass is cracked forming the cathode ray tube in such a state, the crack will extend to release the high deformation energy inherent in the cathode ray tube, finally fracturing the cathode ray tube in some cases. Further, in such a condition that a high stress is applied to an outer surface of the cathode ray tube, delayed fracture (fracture caused after lapse of a period of time) may occur due to the action of moisture in the atmosphere, making it impossible to display an image, in some cases.

Various kinds of display devices, such as liquid crystal display devices and plasma display devices, other than cathode ray tubes, have been recently proposed. In comparison with display devices other than cathode ray tubes, it is pointed out that the display devices comprising a cathode ray tube have a main disadvantage of having a long depth. Although it is desired to decrease the depth in the cathode ray tubes from this viewpoint, a reduction in the depth increases the asymmetry in the structure of the cathode ray tubes, and tensile stresses generated in an outer surface are apt to increase. In particular, an increase in the tensile stresses is also significant in the yoke portion where deformation energy given by deformation in the body portion concentrates.

An increase in the tensile stresses brings about a decrease in reliability because of a reduction in safety by fracture or because of delayed fracture. On the other hand, when the glass thickness of the body portion is increased to prevent the tensile stresses from increasing, the mass of the body portion is further increased. When the glass thickness of the yoke portion is increased, the yoke portion necessarily needs to project inwardly in order to mount a deflection coil on the outer side thereof, causing, e.g., a serious problem that electron beams impinge on an inner surface of the yoke portion to significantly degrade image quality.

It is an object of the present invention to provide a cathode ray tube and a glass funnel applicable to the cathode ray tube, which are capable of being safe, highly reliable and lightweight, wherein a tensile stress, which is generated in the yoke portion or the body portion of a glass funnel to cause fracture in the yoke portion, can be prevented from increasing without increasing the glass thickness of the body portion or the yoke portion.

DISCLOSURE OF THE INVENTION

The inventor has made extensive research to solve the problem and has attained the present invention, founding that a bent portion can be provided at a specific position of a body portion to control the transmission of deformation energy from the body portion to a yoke portion so as to decrease a tensile stress in the yoke portion and to prevent the yoke portion from being fractured.

Specifically, the present invention provides the following modes:

1. A glass funnel for a cathode ray tube, which includes a body portion having an open end formed in a substantially rectangular shape, a neck portion for housing an electron gun, and a yoke portion connecting between the body portion and the neck portion wherein the yoke portion can have a deflection unit mounted on an outer side for deflecting electron beams irradiated from the electron gun, characterized in that an outwardly projecting bent portion is provided along at least a part of an outer peripheral area, where the body portion intersects with a plane perpendicular to a bulb axis, and which includes intersecting points between the outer peripheral area and a plane containing a diagonal axis and the bulb axis, and that the bent portion is positioned so as to satisfy $L/D \leqq ½$, wherein a distance between a boundary between the body portion and the yoke portion, and the bent portion, and a distance between the boundary between the body portion and the yoke portion, and the open end are L and D in terms of components in a relevant diagonal direction, respectively, on the plane containing the relevant diagonal axis and the bulb axis.

2. The glass funnel according to mode 1, wherein a total length of the bent portion along the outer peripheral area was not less than ¼ of a length of the outer peripheral area.

3. The glass funnel according to mode 1 or 2, wherein that the bent portion comprises a projected portion, and that the projected portion has a height of 5 to 50 mm on a plane containing a diagonal axis and the bulb axis.

4. The glass funnel according to mode 1 or 2, wherein that the bent portion comprises a stepped portion, and that the stepped portion has a height of 5 to 50 mm on a plane containing a diagonal axis and the bulb axis.

5. A cathode ray tube using the glass funnel according to any one of modes 1 to 4.

Figure 1:
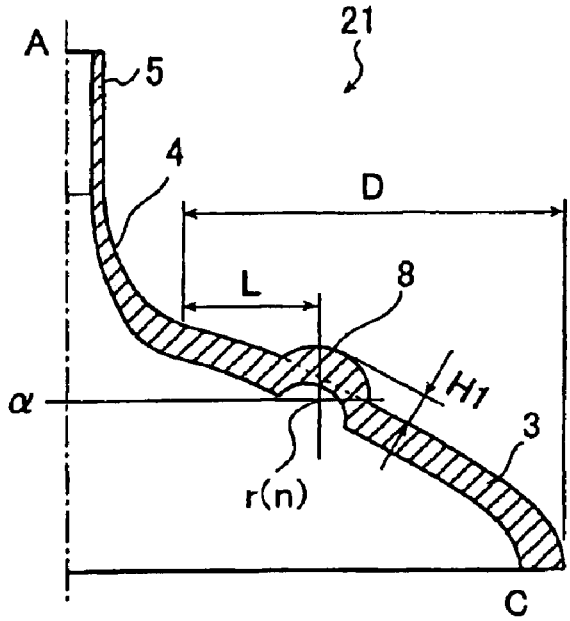
FIG. 1 is a schematic cross-sectional view showing the structure of the glass funnel for a cathode ray tube according to a first embodiment of the present invention.

In the drawings, reference numeral 1 designates a glass panel, reference numeral 2 designates a glass funnel, reference numeral 3 designates a body portion, reference numeral 4 designates a yoke portion, reference numeral 5 designates a neck portion, reference numeral 6 designates an electron gun, reference numeral 7 designates a deflection coil, reference numeral 8 designates a projected portion, reference numerals 9 and 9' designate stepped portions, reference numeral 10 designates a sealing portion, reference numeral 12 designates a fluorescent film, reference numeral 13 designates an aluminum film, reference numeral 14 designates a shadow mask, reference numeral 15 designates a stud pin, reference numeral 16 designates a reinforcing band, reference numeral 17 designates an anode button, reference A designates a bulb axis, reference B designates a reference line, reference C designates a diagonal axis, reference r designates an outer peripheral area, reference n designates an intersecting point, and reference $\alpha$ designates a plane perpendicular to the bulb axis.

BEST MODE FOR CARRYING OUT THE INVENTION

The glass funnel for a cathode ray tube according to the present invention has a bent portion, such as a projected portion or a stepped portion, provided at a specific position of a body portion around a yoke portion as stated earlier, offering an advantage to suppress an increase in a tensile stress in the yoke portion caused by deformation energy in the body portion.

In a cathode ray tube, it is normal that the glass funnel has a neck portion formed at the rearmost position (the position farthest from a glass panel), a yoke portion formed so as to be forward of the neck portion, and a body portion formed so as to be forward of the yoke portion to connect between the yoke portion and a the glass panel provided on a front side of the glass funnel. The glass funnel has a depth shorter than the width of an open end.

For this reason, the body portion is strongly subjected to such a deforming force to be forced in toward the open end by a pressure difference the inside and the outside thereof. As stated earlier, the deformation energy in the body portion eventually concentrates at the yoke portion since the yoke portion is located so as to project toward a central portion of the body portion.

The deformation in the body portion varies among short side walls, long side walls and diagonal walls according to the difference among these sections in terms of area or rigidity. Specifically, the short side walls are deformed so as to be most forced in, the long side walls are greatly deformed, and the diagonal walls are most difficult to be deformed. Under the circumstances, the body portion is deformed in such a complex way that the diagonal walls are deformed as if the diagonal walls are drawn into the long side walls and the short side walls and that the entire body portion is drawn toward the short side walls. This complex deformation generates stresses having a high tensile property (tensile stresses) in diagonal walls and short side walls of the yoke portion.

In accordance with the present invention, in order to suppress the tensile stresses in the yoke portion, the deformation energy in the body portion is controlled before being transmitted to the yoke portion. By additionally providing a structure having a high rigidity (bent portion) to a peripheral wall of the body portion so as to extend in each of the short side walls and the long side wall adjacent thereto with the diagonal wall therebetween being centered the deformation energy to be transmitted to the yoke portion can be substantially equalized to level the deformation in the yoke, reducing the tensile stress. When the bent portion to be provided around the yoke portion continuously extends on the entire periphery of the yoke portion, it is possible to obtain a better effect. The bent portion may be composed of a curved surface, a combination of plural flat surfaces or a combination of a curved surface and a flat surface. For example, by forming the bent portion as a projected portion or a stepped portion, it is possible to easily provide a structure having a high rigidity without increasing the mass or degrading productivity.

Now, the glass funnel for a cathode ray tube and the cathode ray tube according to the present invention will be described in detail, referring to appropriate embodiments shown in some of the accompanying drawings.

Figure 2:
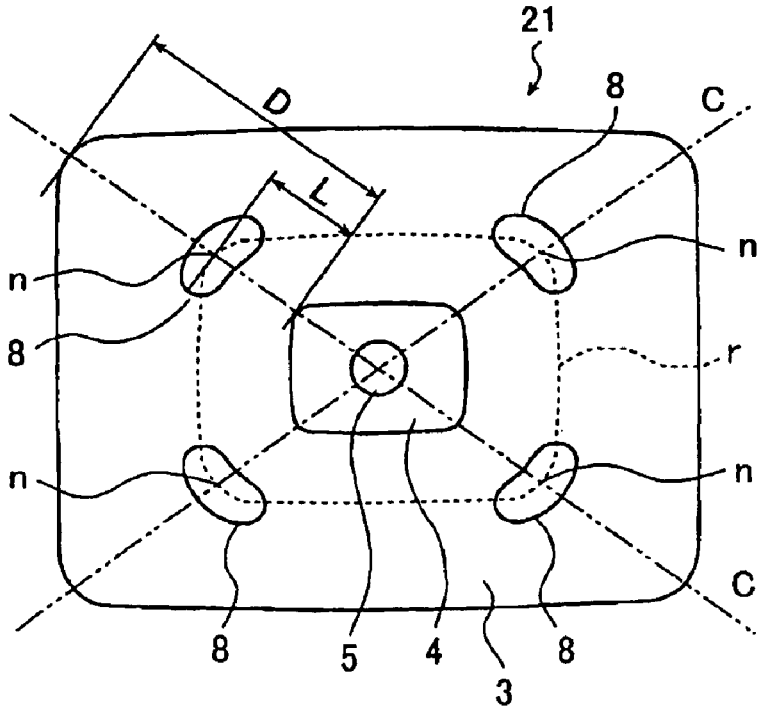
FIG. 2 is a schematic front view showing the structure of the glass funnel for a cathode ray tube according to the first embodiment of the present invention.

FIG. 1 and FIG. 2 are a schematic cross-sectional view and a schematic front view showing the structure of the glass funnel for a cathode ray tube according to a first embodiment of the present invention, respectively.

As shown in FIG. 1, the glass funnel 21 according to the first embodiment includes a body portion 3 having an open end formed in a substantially rectangular shape, a neck portion 5 for housing an electron gun (not shown), and a yoke portion 4 connecting between the body portion 3 and the neck portion 5. Additionally, the yoke portion may have a deflection unit (not shown) mounted on an outer side for deflecting electron beams irradiated from the electron gun.

In FIG. 1 and FIG. 2, projected portions 8 are provided as bent portions projecting outwardly from the body portion 3 along some positions of an outer peripheral area r, where the body portion 3 intersects with a plane α perpendicular to bulb axis A, and which include intersecting points n between the outer peripheral area r and a plane containing a diagonal axis C and the bulb axis A.

In the present invention, the phrase "bulb axis" means a straight line containing a central axis of the neck portion and passing through the center of a face portion. The phrase "diagonal axis" means a diagonal line of the open end formed in a substantially rectangular shape in the body portion.

In the first embodiment shown in FIG. 1 and FIG. 2, the projected portions 8 are not provided on the entire periphery of the outer peripheral area r, and each of the projected portions is provided so as to extend in a short side wall and a long side wall adjacent thereto with the diagonal wall n therebetween being centered. In this embodiment, it was revealed by the numerical experiment based on a finite element method conducted by the inventor that when the sum of the lengths of the projected portions along the outer peripheral area r was not less than ¼ of the length of the outer peripheral area r, it was possible to have a significant effect of avoiding deformation caused by, in particular, generation of tensile stresses. From this viewpoint, it is preferable that the sum of the lengths of the bent portions is not less than ¼ of the length of the outer peripheral area.

The positions of the projected portions 8 satisfy the formula of $L/D \leqq ½$, wherein the distance between the boundary between the body portion 3 and the yoke portion 4, and each of the projected portions 8, and the distance between the boundary between the body portion 3 and the yoke portion 4, and the open end are L and D in terms of components in each of the relevant diagonal directions, respectively, on the plane containing the relevant diagonal axis C and the bulb axis A. The projected portions 8 may be positioned at desired locations in the range satisfying the formula, considering the purpose of design or the positions of other parts.

When a single projected portion 8 is provided on the entire periphery of the outer peripheral area r, the projected portion 8 and its surrounding portions are configured to have a substantially equal thickness. When discontinuous projected portions 8 are provided around the outer peripheral area r, each of the projected portions 8 and other portions in the same cross-section perpendicular to the bulb axis are configured to have a substantially equal glass thickness. In other words, one of the features of the present invention is that the single projection or the discontinuous projected portions are configured to have a hollow space without having a greater thickness.

When the projected portion or portions are provided so as to have a greater thickness as disclosed in JP-Y-57-518, the mass of the glass funnel significantly increases. Additionally, the projected portion or portions having a greater thickness and surrounding portions thereof have different heat capacities because of the difference in volume, the projected portion or portions and the surrounding portions thereof behave in different ways in terms of expansion, shrinkage or the like in a thermal process, and, consequently, stresses (thermal stresses) are generated, causing a crack (fracture).

Conversely, when the projected portion or portions 8 and the surrounding portions thereof are configured to have a substantially equal thickness as in the present invention, it is possible to prevent thermal stresses from causing a crack.

Additionally, in accordance with the present invention, it is possible to provide the glass funnel with a fracture prevention structure without an increase in mass since the projected portion or portions 8 and the surrounding portions thereof are configured to have a substantially equal thickness.

In the first embodiment, the projected portions 8 provided in the body portion 3 are projected portions having a substantially semicircular shape (arched shape) in section as shown in FIG. 1. In the present invention, the projected portions are not limited to have a semicircular shape in section. The projected portions may have any desired shape according to the purpose of design or production capacity as long as the shape is helpful to improve rigidity against bending in the direction of the bulb axis.

It is preferable that the projected portion or portions have a height H1 of 5 to 50 mm. When the height of the projected portion or portions is included in this range, it is possible to increase the effect of preventing tensile stresses from being generated in the yoke portion. It is more preferable that the height H1 is 10 to 30 mm.

The "height of the projected portion or portions" is measured in the direction of a normal line of a section of the body portion close to a projected portion in the plane containing the diagonal axis and the bulb axis.

The number of the projected portion or portions 8 may be one or more in the plane containing a diagonal axis C and the bulb axis A.

There may be bent portions, which are not located at the intersection n between a plane containing a diagonal axis C and the bulb axis A and the outer peripheral areas r.

As shown in FIG. 2, the glass funnel according to the first embodiment is a glass funnel, where the yoke portion has a substantially rectangular cross-section perpendicular to the bulb axis.

Although the glass funnel according to the present invention may have the yoke portion formed in any shape, the provision of the bent portion or portions is particularly effective when the yoke portion has a substantially rectangular cross-section perpendicular to the bulb axis. This is because this shape of yoke portion has different rigidities in different directions.

When the yoke portion has a substantially rectangular cross-section perpendicular to the bulb axis, the yoke portion is influenced directly by the deformation in the body portion since the yoke portion has a similar structure to the body portion. Accordingly, this shape of yoke portion is apt to have greater tensile stresses than yoke portions having another cross-section. From this viewpoint as well, the provision of the bent portion or portions is significantly effective.

Figure 3:
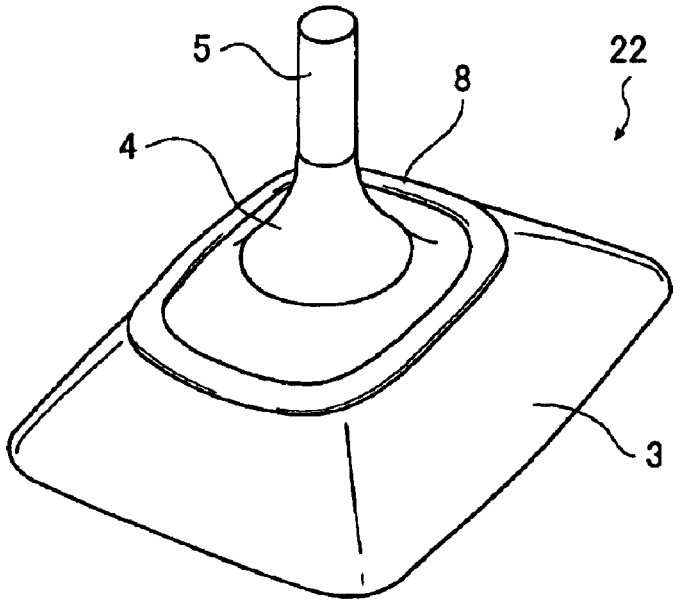
FIG. 3 is a schematic perspective view showing the structure of the glass funnel for a cathode ray tube according to a second embodiment of the present invention.

FIG. 3 is a schematic perspective view showing the structure of the glass funnel for a cathode ray tube according to a second embodiment of the present invention. Explanation of the second embodiment will be made, focusing on different features from the first embodiment, and explanation of similar features to the first embodiment will be omitted.

In the second embodiment, as shown in FIG. 3, the glass funnel 22 includes a yoke portion 4 having a circular cross-section perpendicular to the bulb axis, and a single projected portion 8 is provided on the entire periphery of an outer peripheral area of a body portion 3 close to the yoke portion 4. When the projected portion 8 is seen from a direction of the bulb axis, the projected portion is formed in such a shape between a circular shape and a rectangular shape so as to correspond to the shape of the outer peripheral area of the body portion, where the projected portion is provided. The glass funnel according to the second embodiment has a cross-section containing the bulb axis and a diagonal axis formed in a similar shape to the first embodiment shown in FIG. 1. In other words, the glass funnel according to the second embodiment has the projected portion formed in a semi-circular shape as the bent portion.

Figure 4:
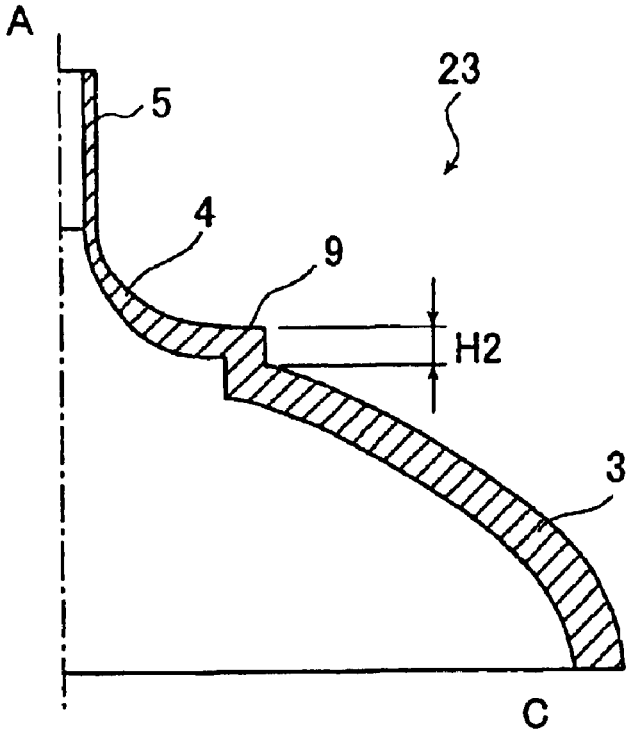
FIG. 4 is a schematic cross-sectional view showing the structure of the glass funnel for a cathode ray tube according to a third embodiment of the present invention.
Figure 5:
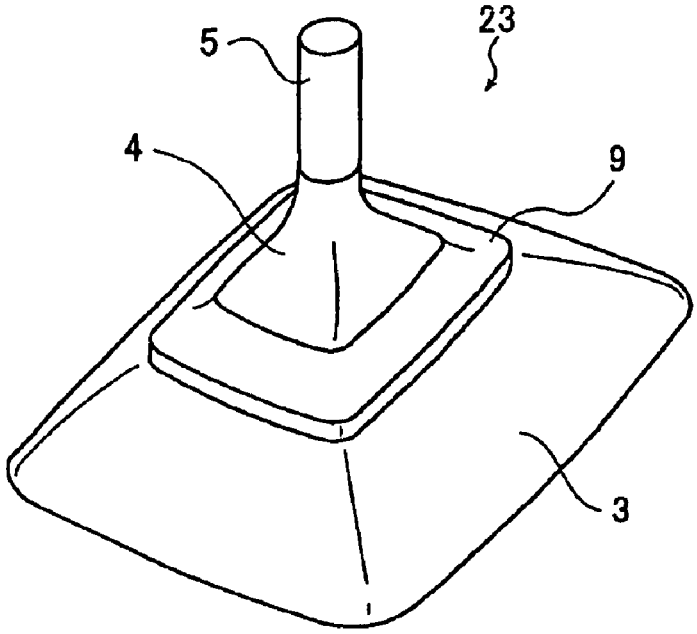
FIG. 5 is a schematic perspective view showing the structure of the glass funnel for a cathode ray tube according to the third embodiment of the present invention.

FIG. 4 and FIG. 5 are a schematic cross-sectional view and a schematic perspective view showing the structure of the glass funnel for a cathode ray tube according to a third embodiment of the present invention, respectively. Explanation of the third embodiment will be made, focusing on different features from the first embodiment and the second embodiment, and explanation of similar features to the first and second embodiments will be omitted.

The glass funnel 23 according to the third embodiment has a stepped portion 9 provided on the entire periphery of an outer peripheral area of a body portion 3 close to a yoke portion 4.

In FIG. 4 and FIG. 5, the stepped portion 9 has a rectangular shape when being seen from a direction of the bulb axis. The stepped portion may have another shape, such as a circumferential shape. The stepped portion may have any shape as long as the stepped portion is provided so as to extend in a long side wall and a short side wall adjacent thereto with the diagonal wall therebetween being centered. The shape of the stepped portion may be selected, considering the purpose of design or productivity.

It is preferable that the stepped portion has a height H2 of 5 to 50 mm. When the height of the stepped portion is included in this range, it is possible to increase the effect of preventing tensile stresses from being generated in the yoke portion. When the stepped portion is discontinuously provided around the outer peripheral area of the body portion, the height H2 is preferably 10 to 40 mm, more preferably 10 to 30 mm.

The "height of the stepped portion" is measured in a direction of the bulb axis in the plane containing a diagonal axis and the bulb axis.

Figure 6:
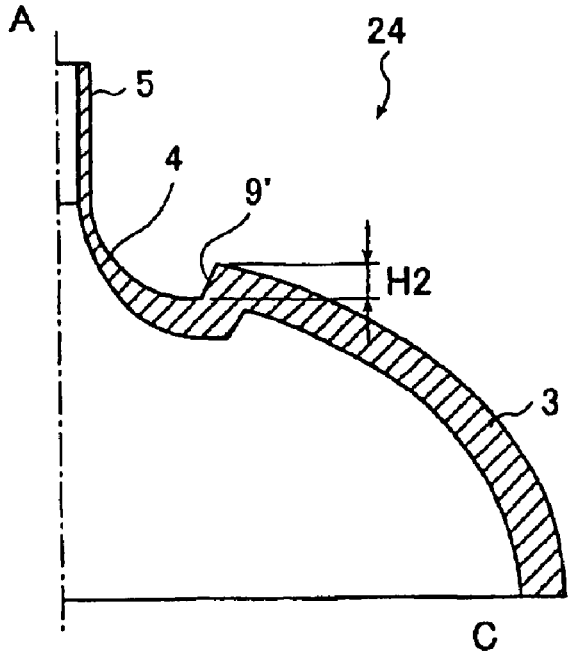
FIG. 6 is a schematic cross-sectional view showing the structure of the glass funnel for a cathode ray tube according to a fourth embodiment of the present invention.
Figure 7:
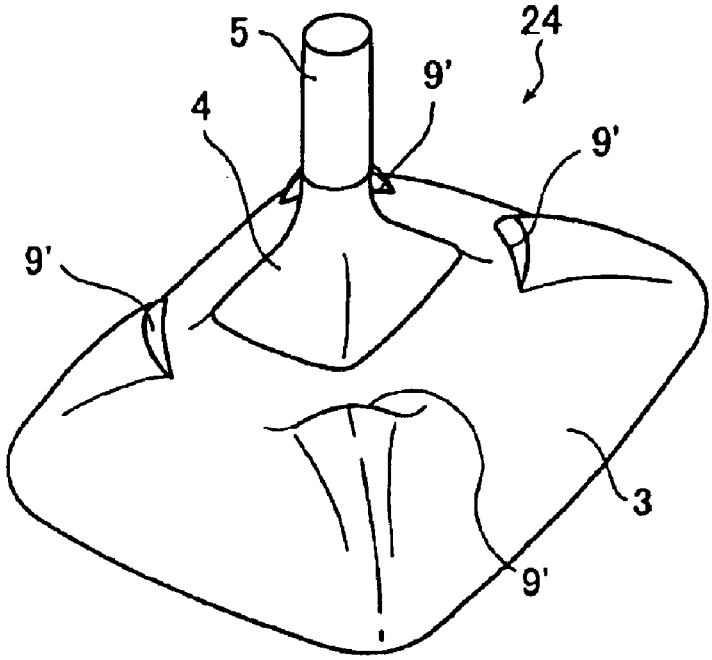
FIG. 7 is a schematic perspective view showing the structure of the glass funnel for a cathode ray tube according to the fourth embodiment of the present invention.

FIG. 6 and FIG. 7 are a schematic cross-sectional view and a schematic perspective view showing the structure of the glass funnel for a cathode ray tube according to a fourth embodiment of the present invention. Explanation of the fourth embodiment will be made, focusing on different features from the first embodiment, and the second embodiment and the third embodiment, and explanation of similar features to the first to third embodiments will be omitted.

The glass funnel 24 according to the fourth embodiment has stepped portions 9' provided therein so that each of the stepped portions extend in a short side wall and a long side wall adjacent thereto with the diagonal wall therebetween being centered, without being continuously provided on the entire periphery of the outer peripheral area.

Each of the stepped portions 9' according to the fourth embodiment is configured so as to be raised on the side close to a body portion 3 and lowered on the side close to a yoke portion 4 in the cross-section containing the bulb axis A and a diagonal axis C, which is opposite to the stepped portion 9 according to the third embodiment. Both stepped portions according to the fourth embodiment and stepped portion according to the third embodiment can enjoy the advantage of the present invention.

Although the glass funnel for a cathode ray tube according to the present invention has been described based on the respective embodiments shown, the present invention is not limited to these embodiments. For example, the structure of each of the parts may be substituted by another structure capable of performing a similar function.

Although explanation of the embodiments has been made about a case wherein a projected portion or a stepped portion is provided as the bent portion, the present invention is not limited to such a case. The present invention may use a combination of a projected portion and a stepped portion, or use another structure capable of performing a similar function.

The glass funnel according to the present invention is extremely effective since it is possible to realize a decrease in tensile stresses caused in the yoke portion and a reduction in weight without significantly modifying the structure of a conventional glass funnel as stated earlier and since it is possible to put the present invention into practice in an extremely simple fashion and to have a high degree of freedom in design.

The cathode ray tube according to the present invention is applicable to any kinds of cathode ray tube as long as the glass funnel for a cathode ray tube according to the present invention is used. Specifically, the cathode ray tube may be composed of, e.g. a glass bulb wherein the glass funnel for a cathode ray tube according to the present invention is combined with a conventional glass panel.

The cathode ray tube according to the present invention is difficult to be fractured, is lightweight and easy to be produced since the glass funnel for a cathode ray tube according to the present invention is used.

Although the present invention will be specifically explained by showing examples, the present invention is not limited to the examples.

Glass panels for 32-inch TV broadcast receivers, which had an aspect ratio of 16:9 and an effective screen with a diagonal size of 76 cm, and the glass funnels in Examples 1 to 6 and Comparative Examples 1 to 3 stated below, which had different dimensions and shapes, were sealed in pairs and evacuated. A strain gauge KFG-5-120-D16-11 manufactured by KYOWA ELECTRONIC INSTRUMENTS CO., LTD. was affixed to the respective yoke portions to measure the maximum tensile stress therein. The glass materials used for the respective parts are listed in Table 1 (all manufactured by Asahi Glass Company, Limited).

The mass and the dimensions of each of the respective glass funnels, and the maximum tensile stress of each of the yoke portions are shown in Table 2. The glass funnels in the examples and the comparative examples had a deflection angle of 120° C.

TABLE 1

| Glass | Panel glass | Funnel glass | Neck glass |
|---|---|---|---|
| Name (brand name) | 5008 | 0138 | 0150 |
| Density ($g/cm^3$) | 2.79 | 3.00 | 3.29 |
| Young's modulus (GPa) | 75 | 69 | 62 |
| Poisson's ratio | 0.21 | 0.21 | 0.23 |

TABLE 1-continued

| Glass | Panel glass | Funnel glass | Neck glass |
|---|---|---|---|
| Softening point (° C.) | 703 | 663 | 643 |
| Annealing point (° C.) | 521 | 491 | 466 |
| Strain point (° C.) | 477 | 453 | 428 |

EXAMPLE 1

A glass funnel having a projected portion provided around the entire periphery of the outer peripheral area as shown in FIG. 3.

EXAMPLE 2

A glass funnel similar to Example 1 except that the thickness of the projected portion and the thickness of the body portion were set as listed in Table 2.

EXAMPLE 3

A glass funnel having a projected portion discontinuously provided around the outer peripheral area as shown in FIG. 1 and FIG. 2.

EXAMPLE 4

A glass funnel having a stepped portion provided around the entire periphery of the outer peripheral area as shown in FIG. 4 and FIG. 5.

EXAMPLE 5

A glass funnel similar to Example 4 except that the total length of the stepped portion along the outer peripheral area was 3/10 of the entire length of the outer peripheral area.

EXAMPLE 6

A glass funnel similar to Example 4 except that the total length of the stepped portion along the outer peripheral area was 4/10 of the entire length of the outer peripheral area.

EXAMPLE 7

Figure 8:
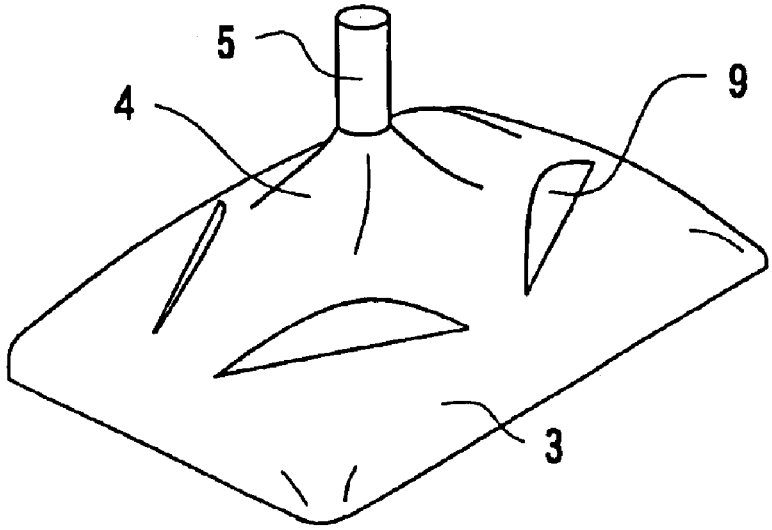
FIG. 8 is a schematic perspective view showing the structure of the glass funnel for a cathode ray tube in Example 7.
Figure 9:
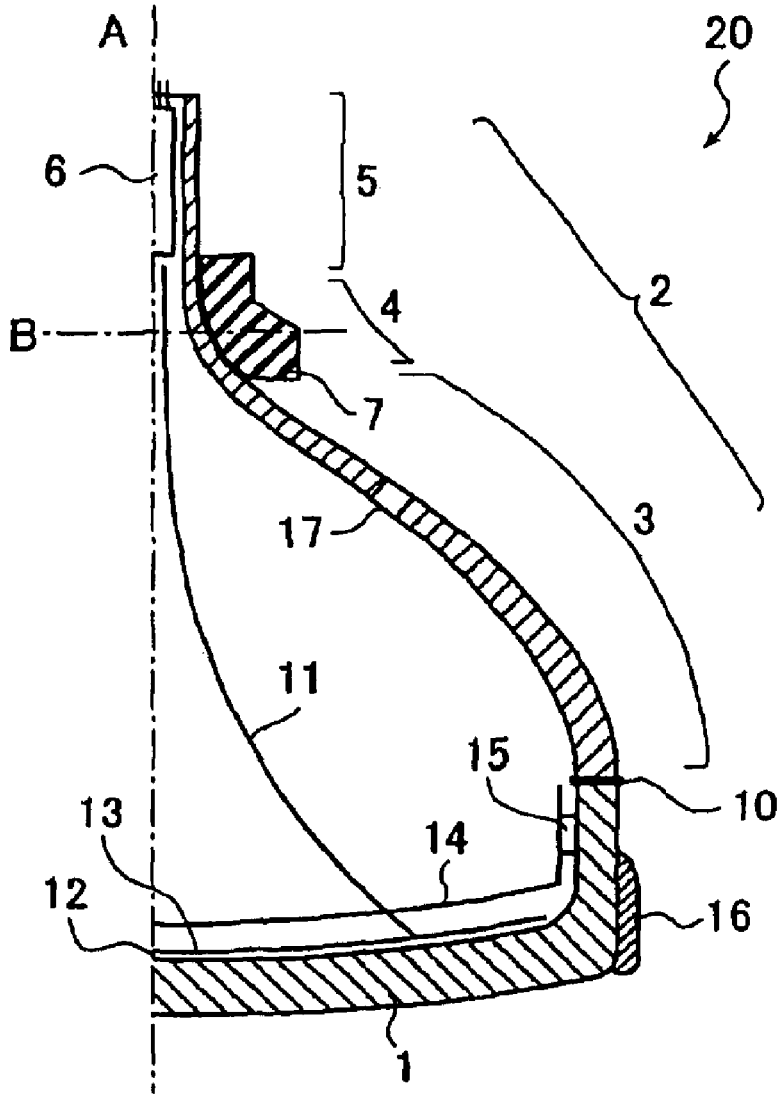
FIG. 9 is a schematic cross-sectional view showing the structure of a conventional glass funnel for a cathode ray tube.

Example 7 represents another embodiment based on the technical idea of the funnel shown in each of Example 5 and Example 6 and has the shape shown in FIG. 8. Specifically, this example is a case wherein the stepped portion was discontinuously provided so that each of the discontinuous sections of the stepped portion extends in a short side wall of the body portion and a long side wall of the body portion adjacent thereto with the diagonal wall therebetween being centered, without being continuously provided on the entire periphery of the outer peripheral area. The stepped portion is configured so as to be lowered on the side close to the open end of the body portion 3 (to be farther from the neck portion) and raised on the side close to the yoke portion 4 (to be closer to the neck portion) as shown in FIG. 8, which is similar to the stepped portion 9 in the third embodiment. The height H2 of the projected portion was 35 mm, and the length of the stepped portion was 3/10 of the entire length of the outer peripheral area.

EXAMPLE 8

A glass funnel similar to Example 7 except that the height H2 of the stepped portion was 25 mm and that the total length of the stepped portion is 7/10 of the entire length of the outer peripheral area.

COMPARATIVE EXAMPLE 1

A glass funnel wherein no bent portion was provided, and the yoke portion had a circular cross-section perpendicular to the bulb axis.

COMPARATIVE EXAMPLE 2

A glass funnel wherein no bent portion was provided, and the yoke portion had a substantially rectangular cross-section perpendicular to the bulb axis.

COMPARATIVE EXAMPLE 3

A glass funnel similar to Comparative Example 2 except that the thickness of the body portion and the thickness of the yoke portion were set as listed in Table 2.

TABLE 2

| | Ex. 1 | Ex. 2 | Ex. 3 | Ex. 4 | Ex. 5 | Ex. 6 | Ex. 7 | Ex. 8 | Comp. Ex. 1 | Comp. Ex. 2 | Comp. Ex. 3 |
|---|---|---|---|---|---|---|---|---|---|---|---|
| Height of projected portion (mm) | 5.0 | 5.0 | 10.0 | — | — | — | — | — | — | — | — |
| Thickness of the projected portion (mm) | 7.5 | 6.5 | 6.5 | — | — | — | — | — | — | — | — |
| Length of projected portion (ratio in comparison with provision around entire periphery of outer peripheral area) (mm) | 1 (entire peri-phery) | 1 (entire peri-phery) | 0.4 | — | — | — | — | — | — | — | — |
| Height of stepped portion (mm) | — | — | — | 5.0 | 5.0 | 5.0 | 35.0 | 25.0 | — | — | — |
| Thickness of stepped portion (mm) | — | — | — | 6.5 | 6.5 | 6.5 | 6.5 | 10.0 | — | — | — |
| Length of stepped portion (ratio in comparison with provision around entire periphery of outer peripheral area) (mm) | — | — | — | 1 (entire peri-phery) | 0.3 | 0.4 | 0.3 | 0.7 | — | — | — |
| Distance between boundary | 75.0 | 75.0 | 75.0 | 50.0 | 50.0 | 50.0 | 100.0 | 35.0 | — | — | — |

TABLE 2-continued

| | Ex. 1 | Ex. 2 | Ex. 3 | Ex. 4 | Ex. 5 | Ex. 6 | Ex. 7 | Ex. 8 | Comp. Ex. 1 | Comp. Ex. 2 | Comp. Ex. 3 |
|---|---|---|---|---|---|---|---|---|---|---|---|
| between body portion and yoke portion, and projected portion (L) (mm) | | | | | | | | | | | |
| Distance between boundary between body portion and yoke portion, and open end (D) (mm) | 308.9 | 308.9 | 308.9 | 308.9 | 308.9 | 308.9 | 308.9 | 308.9 | 308.9 | 308.9 | 308.9 |
| L/D | 0.2 | 0.2 | 0.2 | 0.2 | 0.2 | 0.2 | 0.3 | 0.1 | — | — | — |
| Thickness of body portion (at position of 50 mm from open end on short axis) (mm) | 7.5 | 6.5 | 6.5 | 6.5 | 6.5 | 6.5 | 6.5 | 6.5 | 7.5 | 6.5 | 9.0 |
| Thickness of yoke portion (on reference line is diagonal axis) (mm) | 3.0 | 3.0 | 3.5 | 3.0 | 3.0 | 3.0 | 3.0 | 3.0 | 3.0 | 3.5 | 3.0 |
| Mass of glass funnel (kg) | 11.8 | 11.0 | 10.9 | 11.0 | 11.0 | 11.0 | 11.1 | 11.1 | 11.8 | 11.9 | 12.5 |
| Maximum tensile stress in yoke portion (MPa) | 6 | 7 | 8 | 7 | 8 | 8 | 8 | 7 | 10 | 12 | 8 |

As clearly seen from Table 2, the glass funnel in Example 1 as an example of the glass funnel for a cathode ray tube according to the present invention was able to reduce the tensile stress in the yoke portion by 40% in comparison with the glass funnel in Comparative Example 1, which had the respective parts set at the same dimensions.

In the glass funnel in Example 2 as an example of the glass funnel for a cathode ray tube according to the present invention, an attempt was made to reduce the thickness of the projected portion and the thickness of the body portion so as to realize a reduction in weight, taking advantage of the reduction in the tensile stress in the yoke portion of the glass funnel in Example 1. Example 2 was able to reduce the mass by about 7% in comparison with Comparative Example 1 without the tensile stress in the yoke portion being substantially changed in comparison with the case of Example 1.

The glass funnel in Example 3 as an example of the glass funnel for a cathode ray tube according to the present invention was able to reduce the tensile stress in the yoke portion by 33% in comparison with the glass funnel in Comparative Example 2, which had the respective parts set at the same dimensions.

It is seen that the glass funnel in Example 4 as an example of the glass funnel for a cathode ray tube according to the present invention has an excellent balance between the reduction in the tensile stress in the yoke portion and the reduction in the mass in comparison with the glass funnels in Comparative Examples 1 to 3, which had the respective parts set at the same dimensions.

The glass funnels in Example 5 and Example 6 as examples of the glass funnel for a cathode ray tube according to the present invention is different from Example 4 in that the stepped portion is discontinuously provided. Each of Example 7 and Example 8 represents another embodiment based on the technical idea of the funnel shown in Example 5 and Example 6. It is seen that the tensile stress in the yoke portion of the funnel in each of Examples 5 to 8 is not almost different from that in Example 4, and that the funnel in each of Examples 5 to 8 has an excellent balance between the reduction in the tensile stress in the yoke portion and the reduction in the mass in comparison with the glass funnels in Comparative Examples 1 to 3, which had the respective parts set at almost the same dimensions.

On the other hand, the glass funnel in each of Comparative Example 1 and Comparative Example 2, each of which is directed to a conventional glass funnel for a cathode ray tube having no bent portion (neither a projected portion nor a stepped portion), cannot be put to use since the yoke portion is subjected to a high tensile stress and has a low reliability.

The glass-funnel in Comparative Example 3 as a conventional glass funnel for a cathode ray tube, wherein the body portion has a greater thickness instead of having a bent portion in order to minimize the tensile stress in the yoke portion, is heavy in mass.

INDUSTRIAL APPLICABILITY

The glass funnel according to the present invention is difficult to be fractured since the body portion can have the bent portion provided therein to reduce the tensile stresses caused in the yoke portion. The glass funnel according to the present invention is lightweight since the glass thickness in the body portion or the yoke portion does not increase. The glass funnel according to the present invention can be produced by an extremely simple method. The glass funnel according to the present invention needs to significantly modify the composition and the structure of a conventional glass funnel.

In accordance with the present invention, it is possible to provide a glass funnel and a cathode ray tube, which are capable of being safe, highly reliable and lightweight.

The entire disclosure of Japanese Patent Application No. 2001-319107 filed on Oct. 17, 2001 including specification, claims, drawings and summary is incorporated herein by reference in its entirety.

What is claimed is:

1. A glass funnel for a cathode ray tube, comprising:

a body portion having an open end formed in a substantially rectangular shape;

a neck portion for housing an electron gun;

a yoke portion connecting the body portion and the neck portion, the yoke portion being configured to have a deflection unit mounted on an outer side configured to deflect electron beams irradiated from the electron gun; and an outwardly projecting bent portion provided along at least a part of an outer peripheral area where the body portion intersects with a plane perpendicular to a bulb axis that includes intersecting points between the outer peripheral area and a plane containing a diagonal axis and the bulb axis, wherein the bent portion is positioned so as to satisfy $L/D \leqq 1/2$, where L is a distance from a boundary between the body portion and the yoke portion to the bent portion, and D is a distance from the boundary between the body portion and the yoke portion to the open end in terms of components in a relevant diagonal direction on the plane containing the relevant diagonal axis and the bulb axis.

2. The glass funnel according to claim 1, wherein a total length of the projecting bent portion along the outer peripheral area is not less than ¼ of a length of the outer peripheral area.

3. The glass funnel according to claim 1, wherein a projected portion of the projecting bent portion has a height of 5 to 50 mm on a plane containing a diagonal axis and the bulb axis.

4. The glass funnel according to claim 1, wherein a stepped portion of the projecting bent portion has a height of 5 to 50 mm on a plane containing a diagonal axis and the bulb axis.

5. A cathode ray tube having a glass funnel for a cathode ray tube, the tube comprising:

a body portion having an open end formed in a substantially rectangular shape;

a neck portion for housing an electron gun;

a yoke portion connecting the body portion and the neck portion, the yoke portion being configured to have a deflection unit mounted on an outer side configured to deflect electron beams irradiated from the electron gun; and an outwardly projecting bent portion provided along at least a part of an outer peripheral area where the body portion intersects with a plane perpendicular to a bulb axis that includes intersecting points between the outer peripheral area and a plane containing a diagonal axis and the bulb axis, wherein the bent portion is positioned so as to satisfy $L/D \leqq 1/2$, where L is a distance from a boundary between the body portion and the yoke portion to the bent portion, and D is a distance from the boundary between the body portion and the yoke portion to the open end in terms of components in a relevant diagonal direction on the plane containing the relevant diagonal axis and the bulb axis.

6. The glass funnel according to claim 1, wherein the projecting bent portion and surrounding portions of the projected portion have substantially equal thicknesses.

7. The glass funnel according to claim 1, wherein the projecting bent portion is provided over the entire outer peripheral area and the projecting bent portion and surrounding portions of the projected portion have substantially equal thicknesses.

8. The glass funnel according to claim 1, wherein a projection of the projecting bent portion has a hollow space.

9. The glass funnel according to claim 1, wherein the projecting bent portion is substantially semicircular in shape.

10. The glass funnel according to claim 3, wherein the height ranges between 10 and 30 mm.

11. The glass funnel according to claim 4, wherein the height ranges between 10 and 40 mm.

12. The glass funnel according to claim 11, wherein the height ranges between 10 and 30 mm.

13. The glass funnel according to claim 1, wherein a maximum tensile stress in the yoke portion ranges from approximately 6 to 8 MPa.

14. The glass tube according to claim 5, wherein a total length of the projecting bent portion along the outer peripheral area is not less than ¼ of a length of the outer peripheral area.

15. The glass tube according to claim 5, wherein a projected portion of the projecting bent portion has a height of 5 to 50 mm on a plane containing a diagonal axis and the bulb axis.

16. The glass tube according to claim 5, wherein a stepped portion of the projecting bent portion has a height of 5 to 50 mm on a plane containing a diagonal axis and the bulb axis.

17. The glass tube according to claim 5, wherein the projecting bent portion and surrounding portions of the projected portion have substantially equal thicknesses.

18. The glass tube according to claim 5, wherein the projecting bent portion is provided over the entire outer peripheral area and the projecting bent portion and surrounding portions of the projected portion have substantially equal thicknesses.

19. The glass tube according to claim 5, wherein a projection of the projecting bent portion has a hollow space.

20. The glass tube according to claim 5, wherein the projecting bent portion is substantially semicircular in shape.

21. The glass tube according to claim 15, wherein the height ranges between 10 and 30 mm.

22. The glass tube according to claim 16, wherein the height ranges between 10 and 40mm.

23. The glass tube according to claim 22, wherein the height ranges between 10 and 30mm.

24. The glass tube according to claim 5, wherein a maximum tensile stress in the yoke portion ranges from approximately 6 to 8 MPa.

* * * * *